US005529748A

United States Patent [19]

Moreton et al.

[11] Patent Number: 5,529,748

[45] Date of Patent: Jun. 25, 1996

[54] METAL MATRIX COMPOSITE

[75] Inventors: Roger Moreton; Christopher J. Peel, both of Fleet; Alan J. Shakesheff, Aldershot, all of United Kingdom

[73] Assignee: The Secretary of Defense in her Britannic Majesty's Government of the United Kingdom of Great Britain and Northern Ireland, United Kingdom

[21] Appl. No.: 347,481

[22] PCT Filed: May 27, 1993

[86] PCT No.: PCT/GB93/01094

§ 371 Date: Dec. 6, 1994

§ 102(e) Date: Dec. 6, 1994

[87] PCT Pub. No.: WO93/25719

PCT Pub. Date: Dec. 23, 1993

[30] Foreign Application Priority Data

Jun. 15, 1992 [GB] United Kingdom ..... 9212634

[51] Int. Cl.[6] ..... C22C 21/12

[52] U.S. Cl. ..... 420/529

[58] Field of Search ..... 420/529, 587

[56] References Cited

U.S. PATENT DOCUMENTS

| | | | |
|---|---|---|---|
| 4,383,970 | 5/1983 | Komuro et al. | 420/529 |
| 4,597,792 | 7/1986 | Webster | 420/529 |
| 4,946,647 | 8/1990 | Rohatgi et al. | 420/529 |

*Primary Examiner*—Melvyn Andrews
*Attorney, Agent, or Firm*—Nixon & Vanderhye

[57] ABSTRACT

A magnesium-free aluminum alloy suitable for use as the matrix alloy in a metal matrix composite material is disclosed which overcomes the drawback of the rapid natural ageing response exhibited by prior art alloys. This facilitates greater flexibility in manufacturing with metal matrix composites because of the improvement in fabricability. The alloy composite comprises 1 to 50% by weight of reinforcing material embedded in a matrix alloy having the following composition in proportions by weight: copper 4–6%, aluminum the balance, save for incidental impurities, and further comprising one of the grain refining additives from the group comprising zirconium, manganese or chromium in an amount up to 0.5% by weight.

8 Claims, 4 Drawing Sheets

METAL MATRIX COMPOSITE

The present invention relates to metal matrix composite materials and in particular to improvements in aluminium matrix alloys for such materials Metal matrix composite materials comprising aluminium-copper-magnesium alloys which contain reinforcements of particulate silicon carbide are currently attracting a great deal of interest amongst aerospace manufacturers. Such materials have the potential to become widely adopted in applications where increased strength and stiffness are required in comparison to conventional aluminium alloys.

However, one of the drawbacks of metal matrix composite materials is that a sufficient quantity of the reinforcing material must be incorporated to achieve significant weight savings or improvements in performance. Addition on this scale is apt to have an adverse effect on certain properties, notably toughness and ductility. Moreover, known composite materials of this type often exhibit a rapid natural ageing response following solution heat treatment, with the result that difficulties are encountered when post-form stretching techniques are used to make extruded product forms or the like.

It is therefore an object of this invention to improve the fabricability of metal matrix composite materials. We have now discovered that the removal of magnesium from the matrix alloy of such materials leads to a surprising but significant improvement in fabricability. Metal matrix composites which use a magnesium-free matrix alloy are much easier to process and show a minimal natural ageing response over prolonged periods.

According to the invention there is provided a metal matrix composite material comprising from 1 to 50% by weight of reinforcing material embedded in an alloy matrix, characterised in that the alloy matrix has the following composition in proportions by weight:

| | |
|---|---|
| copper | 2–6% |
| aluminium | balance, save for incidental impurities, |

wherein the alloy matrix further comprises one of the grain refining additives from the group comprising zirconium, manganese or chromium in an amount up to 0.5% by weight.

The matrix alloy preferably contains from 4–6% by weight of copper. Also, the proportion of grain refining additive is preferably from 0.05 to 0.2% by weight.

In a particularly preferred form, the weight proportion of the reinforcing material is from 10 to 30%, more preferably from 15 to 25% and most especially from 18 to 22%. Suitable materials for the reinforcement-include silicon carbide, alumina, boron, graphite, diamond and boron carbide. These may take the form particles, whiskers, short fibres or continuous fibres, depending upon the particular end use for which the composite material is intended.

The invention will now be described by way of example with reference to the drawings, in which.

The test samples used to obtain the experimental results shown in these graphs were produced from material which had been manufactured by a powder metallurgy route to produce billets 125 mm long and 55 mm in diameter. The billets had a silicon carbide content of 20% by weight, a particulate silicon carbide being used with a mean particle size of 3 μm.

The billets were vacuum degassed for 1 hour at temperatures between 450° and 530° C., followed by hot isostatic pressing within the same temperature range. A suitable pressure range for the hot isostatic pressing stage is from 100 to 250 MPa. The billets used here were pressed at 250 MPa and then forged and hot rolled at 475° C. to a final sheet thickness of 2 mm.

Solution heat treatment was carried out for 40 minutes at 505° C. in an air circulating furnace, followed by cold water quenching. Those specimens which were artificially aged were subjected to heat treatment at 150° C. for times up to 1650 hours.

The presence of magnesium in the matrix alloy had a marked affect on the forging behaviour of billets which had been degassed and hot isostatically pressed at the highest temperature, i.e. 530° C. These specimens exhibited extensive cracking during forging. The forging behaviour could be improved by reducing the temperatures at which degassing and hot isostatic pressing were carried out, best results being obtained in the range 475° to 500° C. Decreasing the temperature still further to 450° C. resulted in slight edge cracking, indicating that the lower temperature limit had been reached for successful forging.

During hot rolling, severe edge cracking and surface crazing occurred in magnesium-containing sheet which had been degassed and hot isostatically pressed at 530° C., but specimens which had been processed in the temperature range 475° to 500° C. showed improved surface finish and less severe edge cracks.

Figure 2:
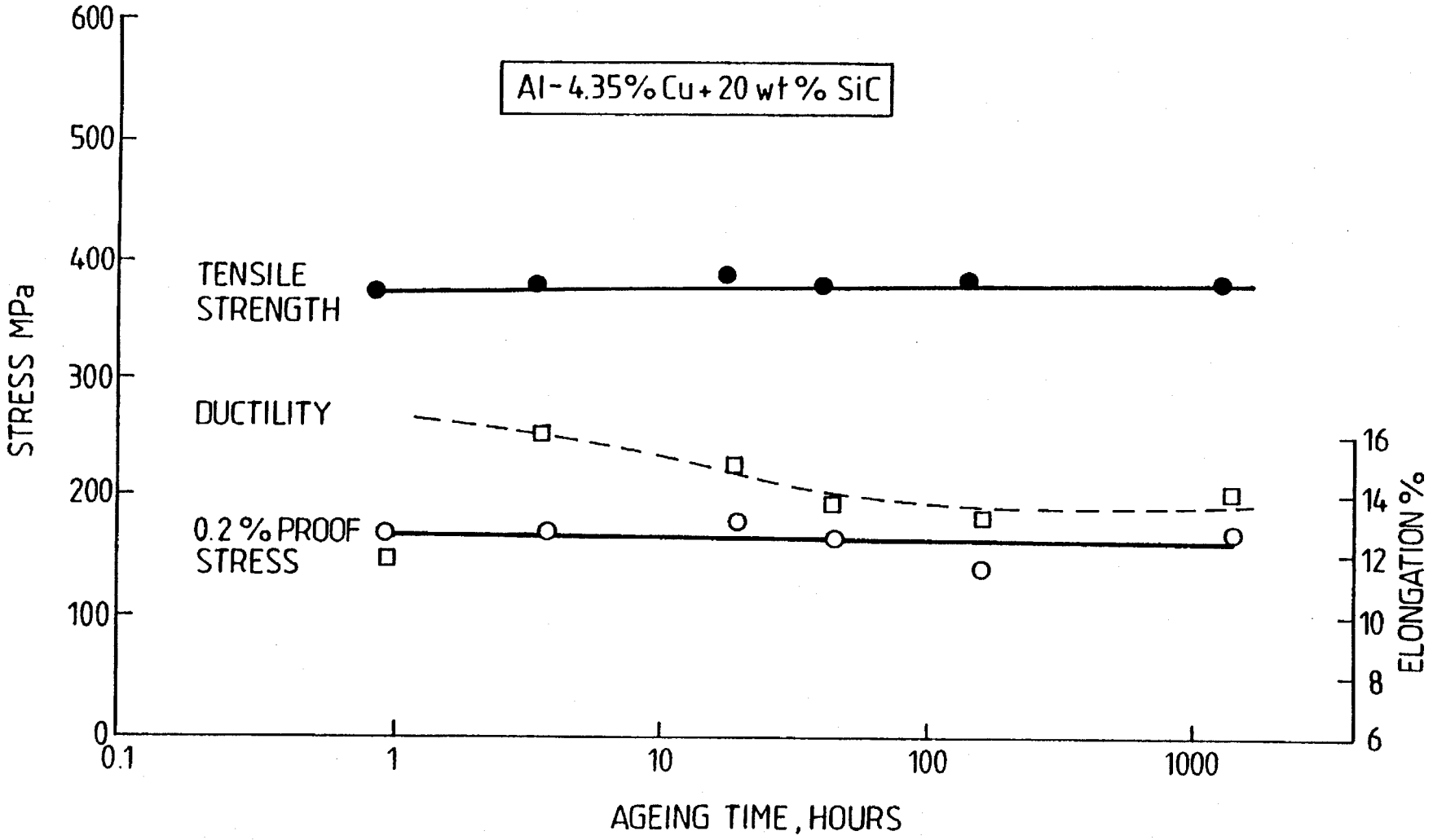
FIG. 2 is a graph showing the effect of natural ageing on the tensile properties of a metal matrix composite according to the invention comprising an Al-4.35% Cu matrix containing by weight of particulate SiC reinforcement.
Figure 4:
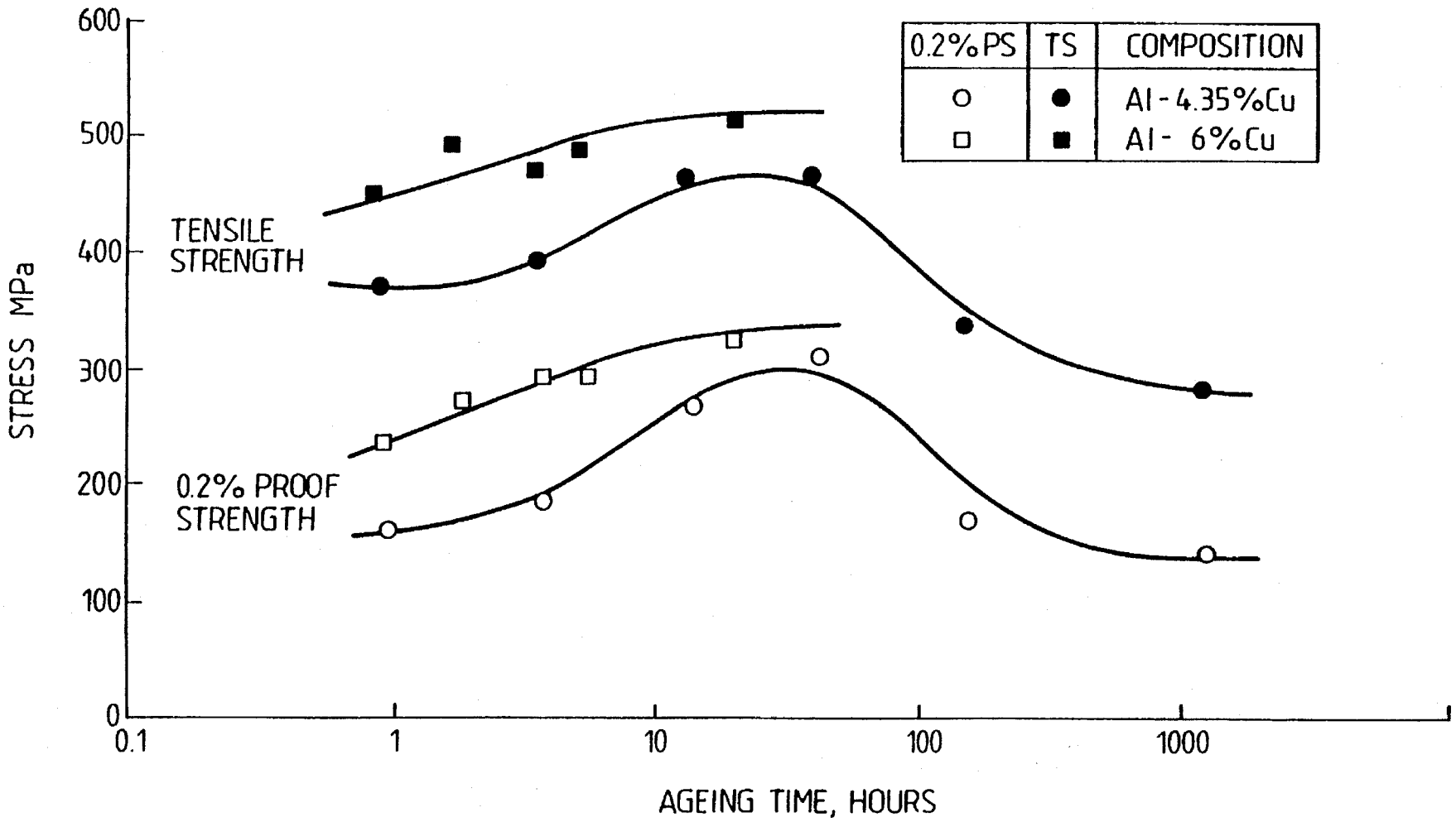
FIG. 4 is a graph showing the effect of artificial ageing at 150° C. in metal matrix composites containing 20% by weight of particulate SiC reinforcement in matrix alloys according to the invention.

By contrast, the magnesium free billets, such as the reinforced Al-4.35% Cu sample whose behaviour is shown in FIGS. 2 and 4, forged without cracking after degassing and hot isostatically pressing at 530° C. Moreover, an improved surface finish with only minor edge cracks was obtained after hot rolling.

Figure 1:
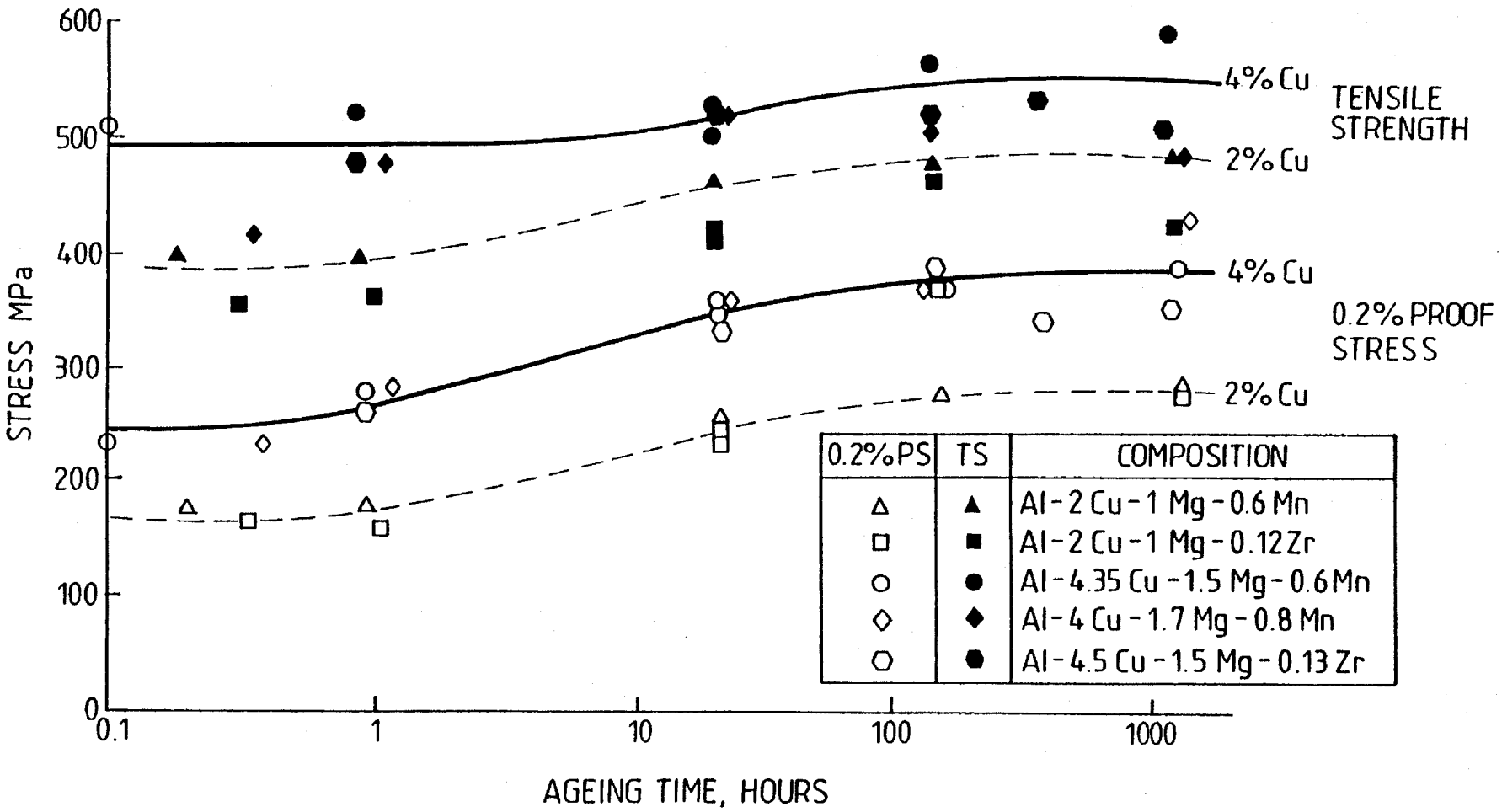
FIG. 1 is a graph showing the effect of matrix alloy composition and natural ageing on the tensile properties of Al/Cu/Mg composites having 20% by weight of particulate SiC reinforcement.

The effect of copper and magnesium content on the tensile properties of reinforced Al/Cu/Mg sheet after solution heat treatment, cold water quenching and natural ageing can be seen with reference to FIG. 1. There was no significant difference between the use of manganese or zirconium as a grain refiner on the tensile properties of the alloy variants studied. Peak aged conditions for the alloys containing nominally 2% and 4% by weight of copper were reached after natural ageing times in excess of 120 hours.

The specimens with reduced copper and magnesium content (Al-2Cu-1Mg-0.6Mn and Al-2Cu-1Mg-0.12Zr) exhibited values of 0.2% proof stress and tensile strength which were respectively around 65 MPa and 110 MPa lower than the values obtained for nominal 4% copper/1.5% magnesium samples in the peak aged condition. At times up to 24 hours after solution heat treatment, these low additive specimens showed slightly higher ductilities (11 to 14%) than the specimens with conventional proportions of copper and magnesium. This improvement in ductility fell to 8 to 11% after 1600 hours.

Figure 3:
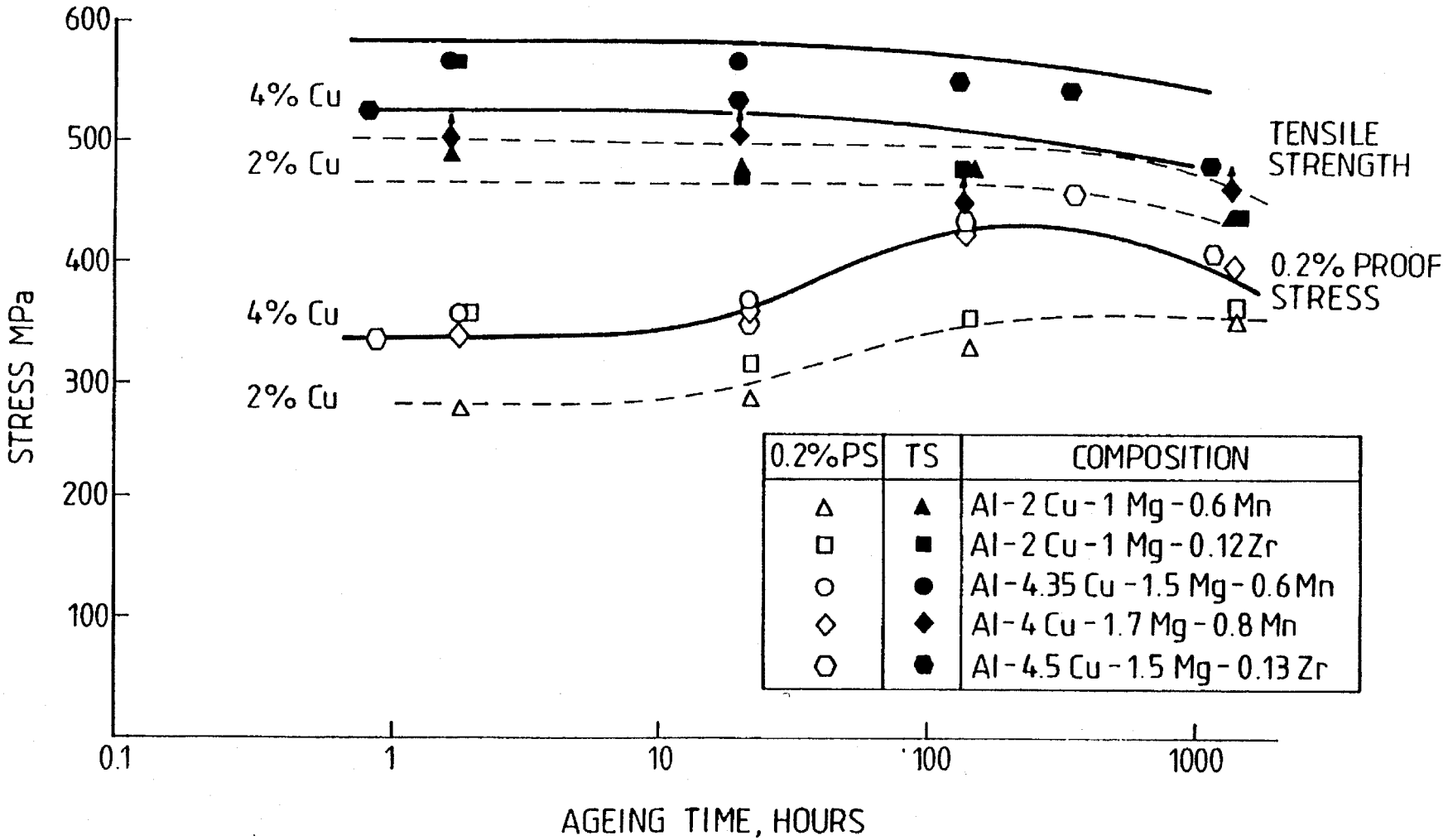
FIG. 3 is a graph showing the effect of matrix alloy composition and artificial ageing at 150° C. on the tensile properties of composite materials corresponding to those used in FIG. 1.

In comparison, the reinforced binary alloy specimen Al-4.35% Cu showed little or no change in 0.2% proof stress or tensile strength during natural ageing for times up to 1500 hours, as seen in FIG. 2. The effect of copper and magnesium content on the tensile properties of corresponding Al/Cu/Mg sheets artificially aged at 150° C. is shown in FIG. 3. The 0.2% proof stresses of all the alloy variants studied were more sensitive to ageing than the tensile strengths, reaching a plateau after 120 hours. Higher copper content specimens showed an 80 MPa greater tensile strength in the peak aged condition, but this differential was reduced after ageing for 1600 hours.

The artificial ageing behaviour of reinforced binary Al/Cu specimens is illustrated with reference to FIG. 4. At short ageing times (up to 1 hour) it is clear that the 0.2% proof stresses and tensile strengths are relatively low compared to specimens containing magnesium. The peak aged condition is reached after 24 to 48 hours. Ductilities varied in inverse proportion to the tensile properties, reaching their lowest values in the peak aged condition.

It is pointed out here that composite specimens containing binary Al/Cu matrix alloys have been used here merely for illustrative purposes. The ageing behaviour of such alloys results in the formation of a relatively coarse grain structure which inevitably leads to slightly depressed tensile properties. Higher values for tensile strength and 0.2% proof stress are obtained in matrix alloys containing a grain refining additive.

Although the invention has been particularly described with reference to composite materials containing 20% by weight of particulate silicon carbide reinforcement, no special significance attaches to this choice of material, nor its form, nor to the proportions in which it has been used. Other manifestations of the invention falling within the scope of the claims which follow will be apparent to persons skilled in the art.

We claim:

1. A metal matrix composite material comprising from 1 to 50% by weight of reinforcing material embedded in an alloy matrix forming the balance of the composite material, wherein the alloy matrix consists essentially of following composition in percent by weight:

copper 2–6%, at least one grain refining additive selected from the group consisting of zirconium, manganese and chromium, up to 0.5%, and aluminum, balance, save for incidental impurities.

2. The metal matrix composite material as claimed in claim 1 wherein the matrix alloy also contains from 4–6% by weight of copper.

3. The metal matrix composite material as claimed in claim 1 wherein the amount of grain refining additive is from 0.05 to 0.2% by weight.

4. The metal matrix composite material as claimed in claim 1 wherein the amount of the reinforcing material is from 10 to 30% by weight.

5. The metal matrix composite material as claimed in claim 4 wherein the amount of the reinforcing material is from 15 to 25% by weight.

6. The metal matrix composite material as claimed in claim 5 wherein the amount of the reinforcing material is from 18 to 22% by weight.

7. The metal matrix composite material as claimed in claim 1 wherein the reinforcing material is selected from the group consisting of silicon carbide, alumina, boron, graphite, diamond and boron carbide.

8. The metal matrix composite material as claimed in claim 1 wherein the reinforcing material is present in the form of particles, whiskers, short fibers or continuous fibers.

* * * * *